US006675512B1

(12) United States Patent
Shwartz et al.

(10) Patent No.: US 6,675,512 B1
(45) Date of Patent: Jan. 13, 2004

(54) DISPLAY ASSEMBLY FOR PLACEMENT ON CLOTHING APPAREL

(75) Inventors: Kenneth A. Shwartz, Mattapoisett, MA (US); Charles Lord, Mattapoisett, MA (US); Anthony Matias, New Bedford, MA (US)

(73) Assignee: Ahead Headgear, Inc., New Bedford, MA (US)

( * ) Notice: Subject to any disclaimer, the term of this patent is extended or adjusted under 35 U.S.C. 154(b) by 0 days.

(21) Appl. No.: 10/347,905

(22) Filed: Jan. 21, 2003

(51) Int. Cl.[7] ..... G09F 3/00

(52) U.S. Cl. ..... 40/329; 40/661.04; 40/661.11; 2/209.13; 2/195.1

(58) Field of Search ..... 40/329, 661.04, 40/661.05, 661.11, 668, 636; 2/209.13, 195.1

(56) References Cited

U.S. PATENT DOCUMENTS

| | | | | | |
|---|---|---|---|---|---|
| 89,108 | A | * | 4/1869 | Woehning | 40/329 |
| 178,908 | A | * | 6/1876 | Clark | 40/668 |
| 5,276,985 | A | * | 1/1994 | Halloran | 40/329 |
| 5,901,370 | A | * | 5/1999 | Linday | 2/209.13 |
| 6,175,963 | B1 | * | 1/2001 | Loeffelholz | 2/209.13 |
| 6,178,680 | B1 | * | 1/2001 | Sloot | 40/661.11 |
| 2001/0034894 | A1 | * | 11/2001 | Godfrey et al. | 2/209.13 |

* cited by examiner

*Primary Examiner*—Gary Hoge
(74) *Attorney, Agent, or Firm*—Foley Hoag LLP

(57) ABSTRACT

A display assembly for placement on an apparel is provided. The assembly includes a flexible layer for placement against the apparel. The assembly further includes a display having pliable extension for penetrating across the flexible layer to securely position the display on the flexible layer. The assembly can be attached to the apparel, including a cap and visor by stitching or sewing the flexible layer to the apparel. A headgear having an assembly exhibiting a display is also provided.

11 Claims, 3 Drawing Sheets

DISPLAY ASSEMBLY FOR PLACEMENT ON CLOTHING APPAREL

TECHNICAL FIELD

The present invention relates generally to accessories for clothing apparel, and more particularly, to an assembly for exhibiting a display on the clothing apparel, such as a cap or a visor.

BACKGROUND ART

Clothing apparel, including headgears (e.g., visors or caps), have been in use for quite some time to display logos, fanciful designs, special events, messages, or just general advertisement. The exhibition of these displays on the apparel, whether for commercial reasons or for decorative purposes, have mostly been on an area where the fabric is sufficiently soft to permit, for instance, embroidering, sewing, stitching or adhesively affixing the display thereon. In those instances where a display is being exhibited on a visor or a cap, the crown of the cap or the area adjacent the bill where the fabric is sufficiently soft may be used. To a certain extent, displays have also been placed and exhibited on the bill of the visor or cap. Displays have also been provided on other areas of a cap or visor. Such displays, regardless of its location on the headgear, often aim to draw the attention of the viewers.

The displays being exhibited on the clothing apparel, as indicated, are typically an embroidered display or a soft display that is capable of being sewn or adhesively affixed to the garment. However, the use of such display may not always be possible or desired. In certain instances, a solid rigid display, such as a plastic or metallic decal may be desired for a particular effect.

Presently, there are caps that are commercially available having rigid metallic displays exhibited thereon. These metallic displays may be affixed to the cap by, for instance, magnetic attraction or by the use of adhesive. The use of magnetic attraction for affixing a metallic display on the cap may not provide the most secured method for maintaining the display on the cap, especially when the cap is worn by a person participating in an activity which involves excessive movements, including head movements. The affixation of a rigid metallic display directly on a cap by adhesion, on the other hand, can minimize the possibility of its displacement from the cap. However, typically, the metallic display needs to be bent slightly to conform to the curvature on the crown of the cap. In this manner the contact surfaces between the display and the cap can be maximized. The deformation of the shape of the display, however, can interfere with the visual effect of the design on the display, which interference can be undesirable in certain instances.

Accordingly, it would be desirable to provide a system and method which can securely exhibit a rigid display and which can minimize the chances of displacement of the display from the clothing apparel.

SUMMARY OF THE INVENTION

The present invention, in accordance with one embodiment, provides a display assembly for attachment to an apparel, for example, a cap or visor. The assembly, as provided, can include a flexible layer for placement on an apparel. The flexible layer, in one embodiment, can be affixed to the apparel by sewing or by gluing the layer to the apparel. The assembly also includes a display (e.g., decal or emblem) for positioning on the flexible layer. The display includes an exposed front surface and a rear surface positioned against the flexible layer. The assembly may further include a plurality of pliable extensions projecting from the rear surface of the display. Each extension is made so that it can penetrate the flexible layer to maintain the display on the flexible layer. Each extension may also be bent to a position substantially transverse to it original position to secure the display against the flexible layer.

In accordance with another embodiment of the invention, a method of exhibiting a rigid display on a clothing apparel is provided. The method includes, providing a display having a front surface and a plurality of extensions projecting from a rear surface of the display. Next, a force may be applied to push the extensions across a flexible layer until the rear surface of the display substantially engages the flexible layer. Subsequently, each extension may be moved to a position relatively transverse to its original position to maintain the display on the flexible layer. Thereafter, the flexible layer having the display thereon, may be affixed to a piece of apparel, such that the extensions are positioned between the apparel and the flexible layer.

The present invention further provides, in another embodiment, a method of exhibiting a display on an apparel. The method includes providing a display having a front surface and a rear surface. Next, a plurality of extensions may be secured to the rear surface of the display, such that the extensions are substantially transverse to the rear surface. A force may then be applied to push the extensions across a flexible layer until the rear surface of the display substantially engages the flexible layer. Subsequently, each extensions may be bent to a position substantially parallel to the rear surface of the display to maintain the display on the flexible layer. Thereafter, the flexible layer having the display thereon, may be affixed to a piece of apparel, such that the extensions are positioned between the apparel and the flexible layer.

The present invention also provides a headgear exhibiting a display. In one embodiment, the headgear includes a crown portion for placement on a head of a person, and a bill portion that is attached to the crown portion. The headgear also includes a flexible layer secured on the crown portion at an area adjacent the bill. The headgear further includes a display having a rear surface positioned against the flexible layer and a plurality of extensions projecting from the rear surface across the flexible layer. With the display positioned on the flexible layer, the extensions are bent substantially parallel to the rear surface of the display and are situated between the crown portion and the flexible layer.

BRIEF DESCRIPTIONS OF THE DRAWINGS

Figure 1:
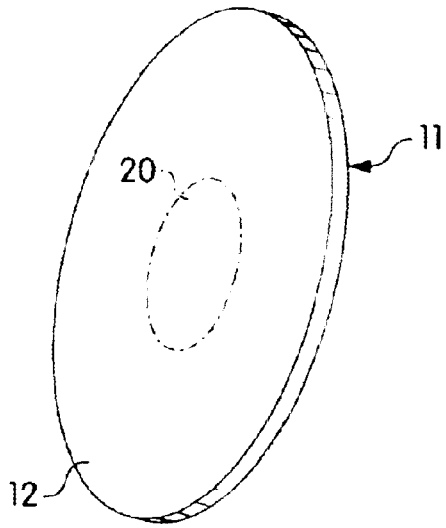
FIG. 1 illustrates a perspective view of a flexible layer for use in connection with a display in accordance with one embodiment of the present invention.
Figure 2:
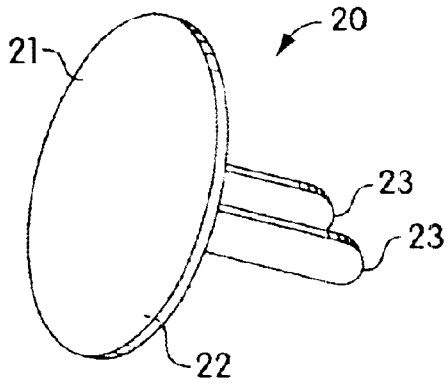
FIG. 2 illustrates the display in accordance with one embodiment of the present invention.
Figure 3A:
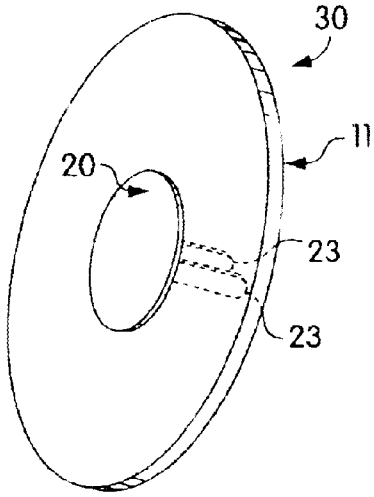
Figure 3B:
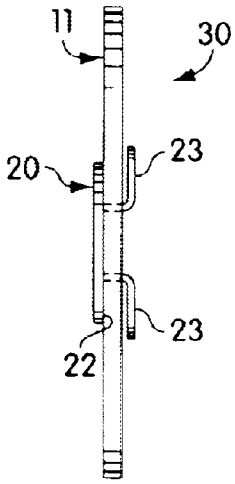

FIGS. 3A–B illustrate an assembly comprising the layer shown in FIG. 1 and display shown in FIG. 2 in two different states.

Figure 4A:
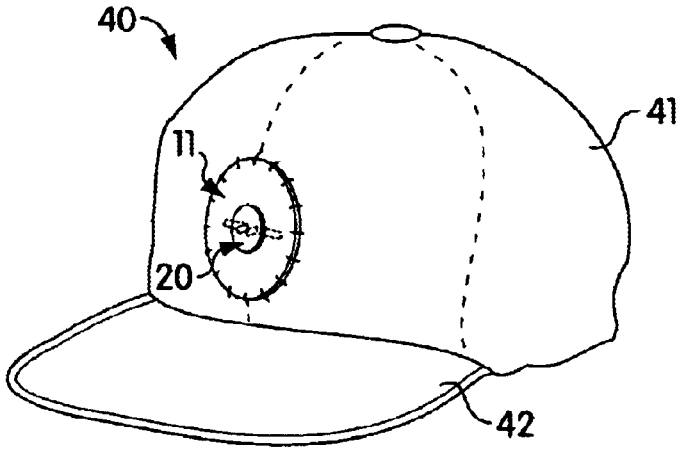
Figure 4B:
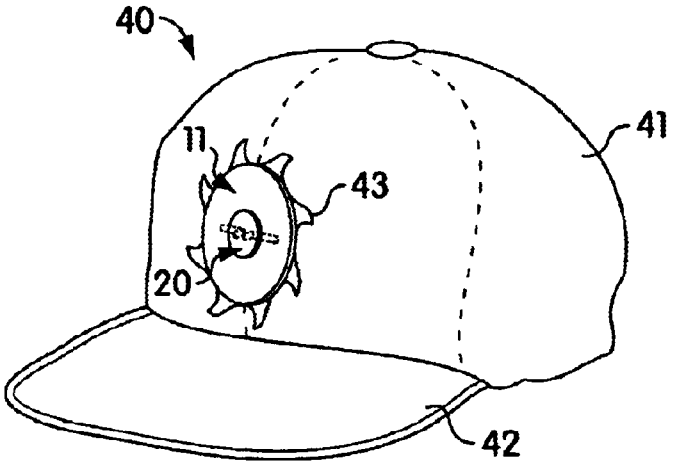

FIGS. 4A–B illustrate the assembly shown in FIG. 3 exhibited on a cap in accordance with various embodiments of the present invention.

DETAILED DESCRIPTION OF SPECIFIC EMBODIMENTS

The present invention provides, as illustrated in FIGS. 1–2, an assembly 10 for decoratively displaying logos, fanciful designs, special events, messages, or just general advertisement on clothing apparel, including headgear, such as a cap or a visor.

In FIG. 1, there is shown an applique or flexible layer 11 for use in the exhibition of a display 20 (FIG. 2) on an apparel. The layer 11, in accordance with one embodiment of the present invention, includes a front side 12 and a rear side (not shown). The front side 12 provides an area to which the display 20 may be positioned, whereas the rear side may be placed against the apparel, when the layer 11 is affixed to the apparel.

As the layer 11 may be affixed to an apparel, for instance, a cap, visor, outerwear or shoe, it is preferable that the layer 11 be made from a material which permits the layer 11 to conform to the surface or area of the apparel onto which the layer 11 may be placed. In one embodiment of the invention, the material from which the layer 11 may be made can be a soft flexible or pliable material, such as leather, cloth, foam, or other comparable materials used for or in connection with apparel. The use of a soft flexible or pliable material can also perm it a stitching, sewing or embroidering needle to penetrate therethrough to secure the layer 11 against the apparel. Alternatively, an adhesive may be used to affix the layer 11 to the apparel.

Looking now at FIG. 2, there is shown a display 20 for decoratively exhibiting logos, fanciful designs, special events or the likes. The display 20, in one embodiment, includes a front surface 21 on which a logo, design or message may be provided. The display 20 also includes a rear surface 22 for placement against the front side 12 of the layer 11. The display 20 further includes a plurality of extensions 23 projecting substantially transversely from the rear surface 22 of the display 20. The extensions 23, in accordance with an embodiment of the present invention, are provided to penetrate across the layer 11, so as to maintain the display 20 on the front side 12 of the layer 11. To that end, each extension 23 may be provided with a sufficient thickness to permit penetration. Moreover, the each extension 23 may made from a material which provides sufficient axial strength along the entire length of the extension 23. To further enhance the position of the display 20 on the layer 11, the extensions 23 may be made from a material that is radially pliable, so as to permit each extension 23 to be bent relatively transversely from its original position. In other words, each extension 23 may be bent to a position substantially parallel to the rear surface 22 of the display 20. The material from which the extension may be made includes, but not limited to, brass, metal alloys and/or other metal composites.

To provide the display 20 with the extensions 23, the extensions 23 may be soldered onto the rear surface 22 of the display 20. Of course other means known in the art may be used to secured the extensions 23 to the display 20. Although illustrated to include two extensions 23, it should be appreciated that additional extensions 23 may be secured to the rear surface 22 of the display 20. For example, the display 20 may be provided with 3, 4 or more extensions 23, so long as the extensions 23 can be bent sufficiently transversely to their original position to secure the display 20 to the layer 11.

The display 20 for use in accordance with an embodiment of the present invention may be made from solid and/or rigid materials such as, metal, wood, plastic or glass, or any other hard solid materials. The use of a rigid solid material can capture an image effect which may not otherwise be attainable when using a typical cloth or embroidered display. Moreover, such solid display materials are durable permitting the display to be exhibited for an extended period of time. An example of a rigid display which may be used in connection with the layer 11 of the present invention is a metallic golf ball marker.

Referring now to FIGS. 3A–B, there are shown an assembly 30 in two different states prior to being affixed to a cap. The assembly 30 comprises the layer 11, shown in FIG. 1, and the display 20, shown in FIG. 2, with the extensions 23 extending across the layer 11 (FIG. 3A). To secure the display 20 against the layer 11, the extensions 23, as shown in FIG. 3B, may be bent to a position that is substantially parallel to the rear surface 22. It should be appreciated that the assembly 30 needs to be in the position shown in FIG. 3B immediately prior to affixing the assembly 30 to a cap.

Looking now at FIGS. 4A–B, the assembly 30 in FIG. 3B may be affixed to a cap 40 by initially positioning the layer 11 with the display 20 thereon against a crown portion 41 at an area adjacent a bill 42 of cap 40. Thereafter, the layer 11 may be sewn or stitched to the cap 40.

Alternatively, rather than sewing or stitching the layer 11 to the cap 40, a design 43, as illustrated in FIG. 4B, may be embroidered along a periphery of the layer 11, over its edges. In this manner, the assembly 30 may be secured against the cap 40 by the embroidered design 43.

It should be appreciated that by affixing the display 20 to the layer 11 rather than the apparel directly, the display 20 may be easily exhibited on the apparel, as the only the layer 11 needs to substantially conform to the surface of the apparel. However, in certain instances, as it may be desirable, the display 20 may be provided with a slight curvature to permit the display 20 to conform to the curvature of the apparel, for example, the crown portion 41 of cap 40.

While the invention has been described in connection with the specific embodiments thereof, it will be understood that it is capable of further modification. For example, although reference has been made to a cap 40, it should be appreciated that a visor, outerwear (e.g., coats, jackets, shirts, pants) and shoes can be easily adapted to include the assembly 30 provided herein. Furthermore, the layer 11 may be made to be of any size and/or shape, so long as it is capable of permitting the display 20 to be secured thereto. This application is intended to cover any variations, uses, or adaptations of the invention, including such departures from the present disclosure as come within known or customary practice in the art to which the invention pertains, and as fall within the scope of the appended claims.

What is claimed is:

1. An assembly for exhibiting a display on an apparel, the assembly comprising:

a flexible layer for placement on an apparel;

a display having an exposed front surface and a rear surface positioned against the flexible layer;

a plurality of pliable extensions projecting from the rear surface of the display and penetrating across the flexible layer, each extension capable of being bent relatively transversely from its original position to secure the display against the flexible layer.

2. An assembly as set forth in claim 1, wherein the layer is made from a material which permits the layer to conform to a curvature along the apparel.

3. An assembly as set forth in claim 1, wherein the display includes a slight curvature to permit the display to conform to a curvature along the apparel.

4. An assembly as set forth in claim 1, wherein the extensions are provided with sufficient axial strength to permit the extensions to penetrate across the layer.

5. An assembly as set forth in claim 1, wherein the extensions are sufficiently radially pliable to permit bending of the extensions to a position substantially transversely from their original position.

6. A method of exhibiting a display on an apparel, the method comprising:

providing a display having a front surface and a plurality of extensions projecting from a rear surface of the display;

applying a force to permit the extensions to penetrate across a flexible layer until the rear surface of the display substantially engages the flexible layer;

moving each extension to a position relatively transverse to its original position to maintain the display on the flexible layer; and affixing the flexible layer onto a piece of apparel, such that the extensions are positioned between the apparel and the flexible layer.

7. A method as set forth in claim 6, wherein affixing includes one of sewing, embroidering and adhesion.

8. A method of exhibiting a display on an apparel, the method comprising:

providing a display having a front surface and a rear surface;

securing a plurality of pliable extensions substantially transverse to the rear surface of the display;

applying a force to permit the extensions to penetrate across a flexible layer until the rear surface of the display substantially engages the flexible layer;

moving each extension to a position substantially parallel to the rear surface of the display to maintain the display on the flexible layer; and securing the flexible layer onto a piece of apparel, such that the extensions are positioned between the apparel and the flexible layer.

9. A method as set forth in claim 8, wherein securing includes one of sewing, embroidering and adhesion.

10. A headgear for exhibiting display, the headgear comprising:

a crown portion for placement on a head of a person;

a bill portion being attached to the crown portion;

a flexible layer secured on the crown portion at an area adjacent the bill; and a display having its rear surface positioned against the flexible layer and a plurality of extensions projecting from its rear surface across the flexible layer, wherein the extensions are substantially parallel to the rear surface of the display and are situated between the crown portion and the flexible layer.

11. A headgear as set forth in claim 10, wherein the display includes a slight curvature to permit the display to conform to a curvature along the crown portion of the headgear.

* * * * *